US010236596B2

(12) United States Patent
Hirakawa et al.

(10) Patent No.: US 10,236,596 B2
(45) Date of Patent: Mar. 19, 2019

(54) CONNECTION TERMINAL

(71) Applicants: Yazaki Corporation, Tokyo (JP); TOYOTA JIDOSHA KABUSHIKI KAISHA, Aichi-ken (JP)

(72) Inventors: Takayoshi Hirakawa, Shizuoka (JP); Yasuhiro Tanaka, Shizuoka (JP); Kengo Machida, Shizuoka (JP); Akio Kitami, Aichi-ken (JP); Kenshi Yamanaka, Aichi-ken (JP)

(73) Assignees: YAZAKI CORPORATION, Tokyo (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/024,629

(22) Filed: Jun. 29, 2018

(65) Prior Publication Data

US 2019/0006773 A1 Jan. 3, 2019

(30) Foreign Application Priority Data

Jul. 3, 2017 (JP) ..... 2017-130125

(51) Int. Cl.

| | |
|---|---|
| ***H01R 11/22*** | (2006.01) |
| ***H01R 13/187*** | (2006.01) |
| ***H01R 4/48*** | (2006.01) |
| ***H01R 4/18*** | (2006.01) |
| ***H01R 4/60*** | (2006.01) |

(52) U.S. Cl.

CPC ..... *H01R 4/48* (2013.01); *H01R 4/184* (2013.01); *H01R 4/60* (2013.01)

(58) Field of Classification Search

None

See application file for complete search history.

(56) References Cited

U.S. PATENT DOCUMENTS

| | | | | |
|---|---|---|---|---|
| 7,717,759 | B2 * | 5/2010 | Ishigami | H01R 4/184 439/748 |
| 10,122,109 | B1 * | 11/2018 | Hirakawa | H01R 13/113 |
| 2005/0014422 | A1 * | 1/2005 | Patel | H01R 13/114 439/851 |
| 2007/0232141 | A1 * | 10/2007 | Tyler | H01R 9/031 439/595 |
| 2016/0181706 | A1 | 6/2016 | Nakano et al. | |
| 2018/0183165 | A1 * | 6/2018 | Balser | H01R 13/112 |

FOREIGN PATENT DOCUMENTS

| | | | |
|---|---|---|---|
| JP | 2016-119292 | A | 6/2016 |

* cited by examiner

*Primary Examiner* — Xuong M Chung Trans

(74) *Attorney, Agent, or Firm* — Kenealy Vaidya LLP

(57) ABSTRACT

A connection terminal includes a terminal main body, a contact member, a locking structure, and a position adjustment structure. The terminal main body is electrically conductive and includes a female connector. The contact member is disposed, in a first region of an internal space of the female connector, to face an inner circumferential surface of the female connector. The locking structure holds the contact member at a position thereof after completion of housing of the contact member in the internal space. The position adjustment structure adjusts the position of the contact member in the internal space. The position adjustment structure includes a locked holder disposed in the contact member and a locking holder disposed in the terminal main body.

6 Claims, 7 Drawing Sheets

CONNECTION TERMINAL

CROSS-REFERENCE TO RELATED APPLICATION(S)

The present application claims priority to and incorporates by reference the entire contents of Japanese Patent Application No. 2017-130125 filed in Japan on Jul. 3, 2017.

BACKGROUND OF THE INVENTION

1. Field of the Invention

The present invention relates to a connection terminal.

2. Description of the Related Art

One known connection terminal includes a terminal main body and contacts. The terminal main body includes a female connector that is disposed in a columnar internal space in which a male connector of a mating male terminal is to be inserted. The contacts are housed inside the internal space and are electrically connected with the female connector and the male connector, respectively. Japanese Patent Application Laid-open No. 2016-119292, for example, discloses such a connection terminal.

When insertion and removal of the male connector is performed in the connection terminal of the foregoing sort, force acts from the male connector on the contact members in insertion and removal directions. Thus, the connection terminal is preferably configured such that relative positional deviation between the contact members is reduced in the internal space in the terminal main body.

SUMMARY OF THE INVENTION

It is an object of the present invention to provide a connection terminal that can maintain correct positions of contact members with respect to a terminal main body.

A connection terminal according to one aspect of the present invention includes an electrically conductive terminal main body including: a female connector that has a columnar internal space in which a male connector of a mating male terminal is to be inserted; and an electric wire connector with which an electrically conductive part of an electric wire is to be electrically connected; a contact member that is disposed to face an inner circumferential surface of the female connector in a first region of two divided regions of the internal space, the two divided regions extending along insertion and removal directions of the male connector, that is electrically connected with the female connector by the inner circumferential surface of the female connector, and that is to be electrically connected with the male connector inserted in the internal space through a first opening in the female connector; a locking structure that holds the contact member at a position at which the contact member is disposed after completion of housing of the contact member in the internal space; and a position adjustment structure that adjusts a position of the contact member in the internal space, wherein the locking structure includes: a locked body that protrudes from an end of the contact member disposed on a side of a second opening in the female connector toward a direction in which the contact member is inserted into the internal space; and a locking body that protrudes from an end on the side of the second opening in the female connector toward the direction in which the contact member is inserted into the internal space, the locked body includes a locked part and the locking body includes a locking part such that, upon completion of housing of the contact member in the internal space, the locked part of the locked body is disposed to face the locking part of the locking body in the insertion and removal directions of the male connector, the position adjustment structure includes a locked holder disposed in the contact member and a locking holder disposed in the terminal main body, and the locking holder includes a locking holding part capable of locking a locked holding part of the locked holder within such a range that the locked part and the locking part are disposed to face each other in the insertion and removal directions of the male connector after the completion of housing of the contact member in the internal space, the locking holding part further being capable of holding the locked holding part under the foregoing locking condition.

According to another aspect of the present invention, in the connection terminal, it is preferable that the locking holding part is formed so as to be capable of locking and holding the locked holding part before the completion of housing of the contact member in the internal space.

According to still another aspect of the present invention, in the connection terminal, it is preferable that the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; and the locked body that protrudes from the second female-side contact part disposed on the side of the second opening toward the insertion direction, and the position adjustment structure uses, as the locked holder, the second female-side contact part that extends along a circumferential direction of the inner circumferential surface of the female connector, uses, as the locked holding part, circumferential ends of the second female-side contact part, and uses, as the locking holder, a bulge that bulges from the inner circumferential surface of the female connector for each locked holding part.

According to still another aspect of the present invention, in the connection terminal, it is preferable that the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; the locked body that protrudes from the second female-side contact part disposed on the side of the second opening toward the insertion direction; and the locked holder that protrudes toward the insertion direction from circumferential ends of the second female-side contact part that extends circumferentially along the inner circumferential surface of the female connector, and the locking holder is provided for each locked holder.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following details, with reference to the accompanying drawings, a connection terminal according to embodiments of the present invention. It should be noted that these embodiments are to be taken as illustrative only and are not intended to limit the present invention.

Embodiments

The following describes, with reference to FIGS. 1 to 4, a connection terminal according to an embodiment of the present invention.

Figure 1:
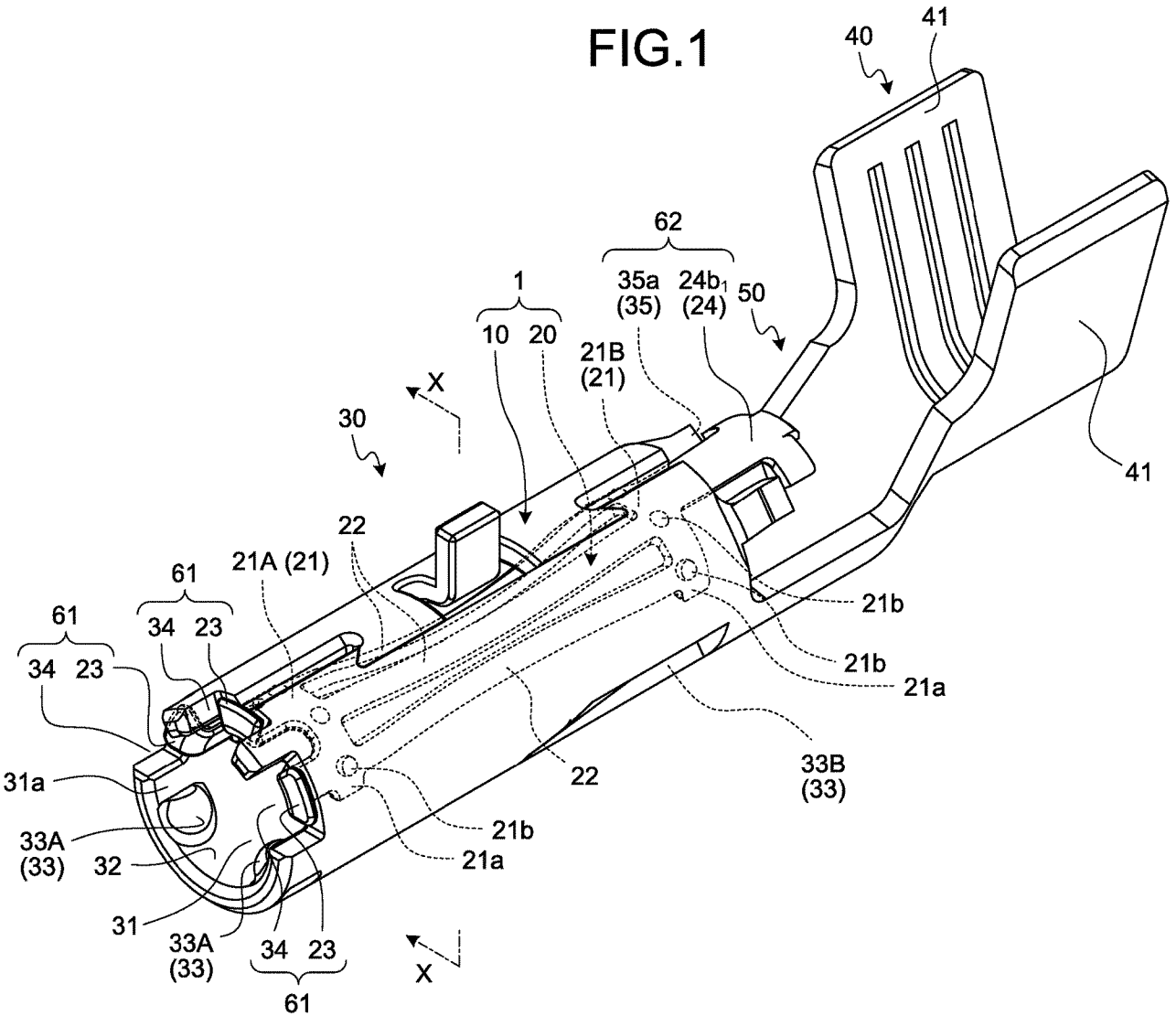
FIG. 1 is a perspective view of a connection terminal in an embodiment.
Figure 2:
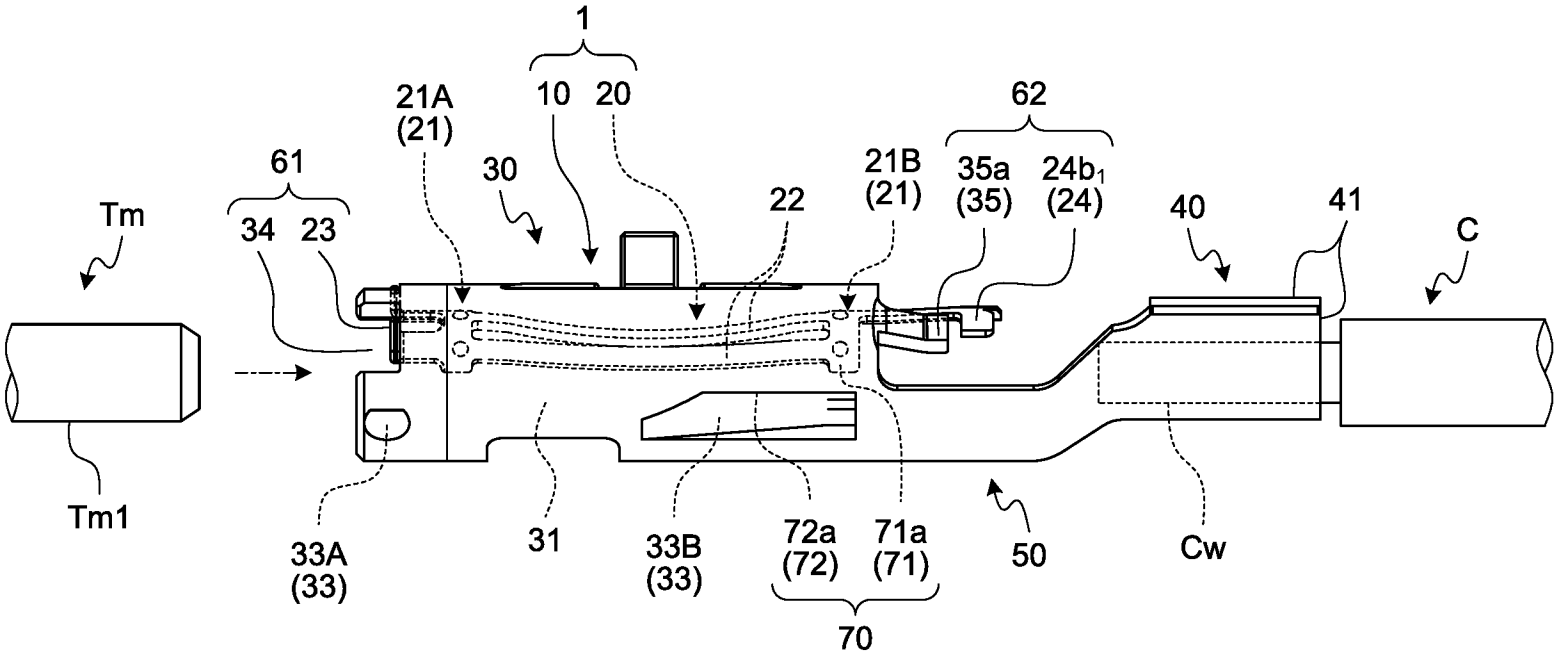
FIG. 2 is a side elevational view of the connection terminal in the embodiment.

Reference numeral 1 in FIGS. 1 to 4 denotes the connection terminal in the present embodiment. The connection terminal 1 is what is called a female terminal. The connection terminal 1 establishes a physical and electrical connection with a mating male terminal Tm (FIG. 2). The connection terminal 1 includes a terminal main body 10 and a contact member 20. The terminal main body 10 is assembled with the contact member 20 to form the connection terminal 1.

The terminal main body 10 is formed of an electrically conductive material such as metal. The exemplary terminal main body 10 includes an electrically conductive metal plate as a base material that is formed into shape through cutting and folding or other metal-forming operation. The terminal main body 10 includes a female connector 30, an electric wire connector 40, and a connecting bridge 50.

The female connector 30 is formed into a female configuration so as to receive a male connector Tm1 of the male terminal Tm to be inserted therein. The insertion of the male connector Tm1 into the female connector 30 establishes an electrical connection. The female connector 30, which can have any outline, is formed into a cylindrical shape to accept the male connector Tm1 that is formed into a columnar shape. The female connector 30 has an internal space 31 having a shape corresponding to the columnar male connector Tm1. The female connector 30 has both ends in a cylindrical axis direction open. An opening on a first end (hereinafter referred to as a "first opening") 31*a* is used as an insertion port for the male connector Tm1 into the internal space 31 (male terminal insertion port). The first opening 31*a* is also used as an insertion port for the contact member 20 into the internal space 31 (contact insertion port). Additionally, the first opening 31*a* is used also as a removal port for the male connector Tm1 to be removed from the internal space 31. An opening on a second end (hereinafter referred to as a "second opening") 31*b* (FIG. 3) is used for operating a locking structure (second locking structure 62) described later.

When the male connector Tm1 is configured as a plate-shaped bus bar or formed into a prism, for example, the female connector 30 is molded into a prism having a prismatic internal space 31 to correspond to the prismatic shape of the male connector Tm1. When the male connector Tm1 is formed into a cylinder, the female connector 30 is molded into a cylinder having a cylindrical internal space 31 to correspond to the cylindrical shape of the male connector Tm1. In the present embodiment, the female connector 30 is molded into a cylinder so as to permit removal and insertion between the male connector Tm1 and the internal space 31 in the female connector 30. The male connector Tm1 is inserted and removed with respect to the internal space 31 along an axis of the female connector 30. In the present embodiment, the plate-shaped base material is folded into a cylinder to thereby form a cylindrical internal space 31 inside the female connector 30. In the following, the direction in which the male connector Tm1 is to be inserted will be referred to as a "male terminal insertion direction" and the direction in which the male connector Tm1 is to be removed will be referred to as a "male terminal removal direction". The direction in which the male connector Tm1 is to be inserted and removed will be referred to as "male terminal insertion and removal directions".

The electric wire connector 40 receives an electrically conductive part Cw (FIG. 2) of an electric wire C. The electrically conductive part Cw of the electric wire C is electrically connected with the electric wire connector 40. Any technique may be used to achieve this connection, including swaging or crimping, welding, and soldering. In the present embodiment, the plate-shaped base material is folded into the electric wire connector 40 having a U-shape. The electric wire connector 40 includes two barrel lugs 41. The barrel lugs 41 face each other. The barrel lugs 41 are each wound around a core wire as the electrically conductive part Cw of the electric wire C to thereby swage over the electrically conductive part Cw, so as to establish a physical and electrical connection with the electrically conductive part Cw.

The connecting bridge 50 is disposed between the female connector 30 and the electric wire connector 40 to thereby connect therebetween.

The contact member 20 is formed so as to follow an inner circumferential surface 32 of the female connector 30 in the terminal main body 10. The contact member 20 is inserted into the internal space 31 in the female connector 30 through the first opening 31*a* to thereby be housed in the internal space 31 in the female connector 30. The internal space 31 is, for example, divided into two regions along the male terminal insertion and removal directions. In a first region of the two regions of the internal space 31, the contact member 20 is disposed to face the inner circumferential surface 32 of the female connector 30. The contact member 20 is electrically connected with the female connector 30 by the inner circumferential surface 32 of the female connector 30 and is also electrically connected with the male connector Tm1 that has been inserted in the internal space 31 through the first opening 31*a*. The contact member 20 is formed of an electrically conductive material such as metal. The contact member 20 in the present embodiment is formed using an electrically conductive metal plate as a base material, on which cutting and folding or other metal-forming operation are performed.

The contact member 20 has an external shape formed so as to follow the inner circumferential surface 32 of the female connector 30 in the first region of the internal space 31, in which the contact member 20 is disposed, regardless of whether the internal space 31 is cylindrical or prismatic. The internal space 31 is cylindrical in the present embodiment. Thus, the contact member 20 has an external shape formed such that different positions in an axial direction form an arcuate shape.

Specifically, the contact member 20 includes a contact part 21 and a contact part 22. The contact part 21 (hereinafter referred to as a "female-side contact part") is electrically connected with the inner circumferential surface 32 of the female connector 30. The contact part 22 (hereinafter referred to as a "male-side contact part") is electrically connected with the male connector Tm1 inserted in the internal space 31.

The female-side contact part 21 extends in a circumferential direction of the inner circumferential surface 32 of the female connector 30 in the first region of the internal space 31. In the present embodiment, the female-side contact part 21 is formed into an arcuate shape along the circumferential direction of the inner circumferential surface 32 of the female connector 30 so as to establish an electric connection in the first region of the internal space 31. The female-side contact part 21 has an arcuate outer circumferential surface 21*a* (FIG. 4) disposed to face the inner circumferential surface 32 and the electric connection is established by the arcuate outer circumferential surface 21*a* with the inner circumferential surface 32 of the female connector 30. In the present embodiment, the outer circumferential surface 21*a* has a plurality of spherical contact points 21*b*. The contact points 21*b* bulge outwardly in a radial direction from the outer circumferential surface 21*a*. The contact points 21*b* are substantially equidistantly disposed along the circumferential direction of the outer circumferential surface 21*a*. The female-side contact part 21 contacts the inner circumferential surface 32 of the female connector 30 via each of the contact points 21*b*.

The contact member 20 in the present embodiment includes two female-side contact parts 21 spaced apart from each other in the male terminal insertion and removal directions (in the cylindrical axis direction of the female connector 30). The two female-side contact parts 21 establish the electric connection with the female connector 30. The female-side contact parts 21 are disposed on the side of the first opening 31*a* and on the side of the second opening 31*b*, respectively, in the internal space 31. In the following, the female-side contact part 21 on the side of the first opening 31*a* will be referred to as a "first female-side contact part 21A" and the female-side contact part 21 on the side of the second opening 31*b* will be referred to as a "second female-side contact part 21B".

At least one male-side contact part 22 is disposed between the two adjacent female-side contact parts 21 to thereby connect the respective female-side contact parts 21. In the present embodiment, four male-side contact parts 22 are disposed between the first female-side contact part 21A and the second female-side contact part 21B. The four male-side contact parts 22 each connect between the first female-side contact part 21A and the second female-side contact part 21B. The male-side contact parts 22 are each pushed to the outside in the radial direction of the internal space 31 (inner circumferential surface 32 side) by the male connector Tm1 inserted in the internal space 31. The male-side contact parts 22 contact the male connector Tm1 at portions pushed by the male connector Tm1 (pushed portions). The male-side contact parts 22 are electrically connected with the male connector Tm1 through the pushed portions that serve as contact points.

The male-side contact parts 22 are formed so as to be elastic in the radial direction of the internal space 31 in which the male-side contact parts 22 are housed. Specifically, the male-side contact parts 22 are formed so as to flex toward the outside in the radial direction of the internal space 31 when the male connector Tm1 is inserted into the internal space 31 and the male-side contact parts 22 are pushed toward the outside in the radial direction by the male connector Tm1. The male-side contact parts 22 in the present embodiment are each formed into an arcuate connection connecting between the first female-side contact part 21A and the second female-side contact part 21B. In the present embodiment, the male-side contact parts 22 are each formed into an arcuate shape protruding inwardly in the radial direction between the two adjacent female-side contact parts 21 (the first female-side contact part 21A and the second female-side contact part 21B), so that an apex of the protrusion on the inside in the radial direction assumes the pushed portion as the contact point.

The contact member 20 is being inserted into the internal space 31, while being narrowed and changing positions thereof in the axial direction (direction extending along a direction in which the contact member 20 is inserted into the internal space 31) as appropriate at a state where the positions thereof are reduced.

The female connector 30 in the present embodiment includes contact parts (hereinafter referred to as "terminal main body contact parts") 33 disposed in a divided second region of the internal space 31 (FIGS. 1 to 4). The terminal main body contact parts 33 bulge inwardly in the radial direction from the inner circumferential surface 32 of the female connector 30. The male connector Tm1, when inserted in the internal space 31, is clamped by the contact member 20 and the respective terminal main body contact parts 33. Specifically, the contact member 20 and the terminal main body contact parts 33 provide retention for the male connector Tm1 in the internal space 31. Thus, the electric connection of the male connector Tm1 with the female connector 30 is achieved indirectly via the contact member 20 and directly by the terminal main body contact parts 33.

The female connector 30 in the present embodiment includes four terminal main body contact parts 33. The four terminal main body contact parts 33 are specifically two first terminal main body contact parts 33A and two second terminal main body contact parts 33B. The two first terminal main body contact parts 33A are disposed on an end on the side of the first opening 31*a* and are spaced apart from each other in the circumferential direction. The two second terminal main body contact parts 33B are disposed on an end on the side of the second opening 31*b* and are spaced apart from each other in the circumferential direction (FIGS. 1 to 4). The first terminal main body contact parts 33A are each a spherical bulge that bulges from the inner circumferential surface 32 inwardly in the radial direction. The second terminal main body contact parts 33B are each a curved bulge that has a curved surface and that bulges from the inner circumferential surface 32 inwardly in the radial direction. The second terminal main body contact parts 33B each extend in the axial direction.

A frictional force, for example, acts between the contact member 20 and the male connector Tm1 during removal or insertion of the male connector Tm1 with respect to the internal space 31 and a force acting in the insertion or removal direction corresponding to the frictional force is applied to the contact member 20 from the male connector Tm1. Thus, with the connection terminal 1 having only the configurations in the present embodiment described above, the contact member 20 can be relatively moved with respect to the female connector 30 (internal space 31) during the removal or insertion of the male connector Tm1 in the removal or insertion direction. The foregoing possibility may involve relative movement of the contact member 20 with respect to the female connector 30 in the axial direction (direction identical to the insertion and removal directions) and the circumferential direction by a possible external input of, for example, oscillation during production of the connection terminal 1 or during transport of the connection terminal 1 after the production even without the force being applied from the male connector Tm1.

The connection terminal 1 in the present embodiment thus includes a locking structure that can lock the condition of the contact member 20 being housed in the internal space 31 with respect to the female connector 30 in order to reduce relative positional deviation with respect to the female connector 30 of the contact member 20 that has been housed in the internal space 31. The locking structure is configured such that the contact member 20 retains a position after the contact member 20 has been housed in the internal space 31.

Figure 4:
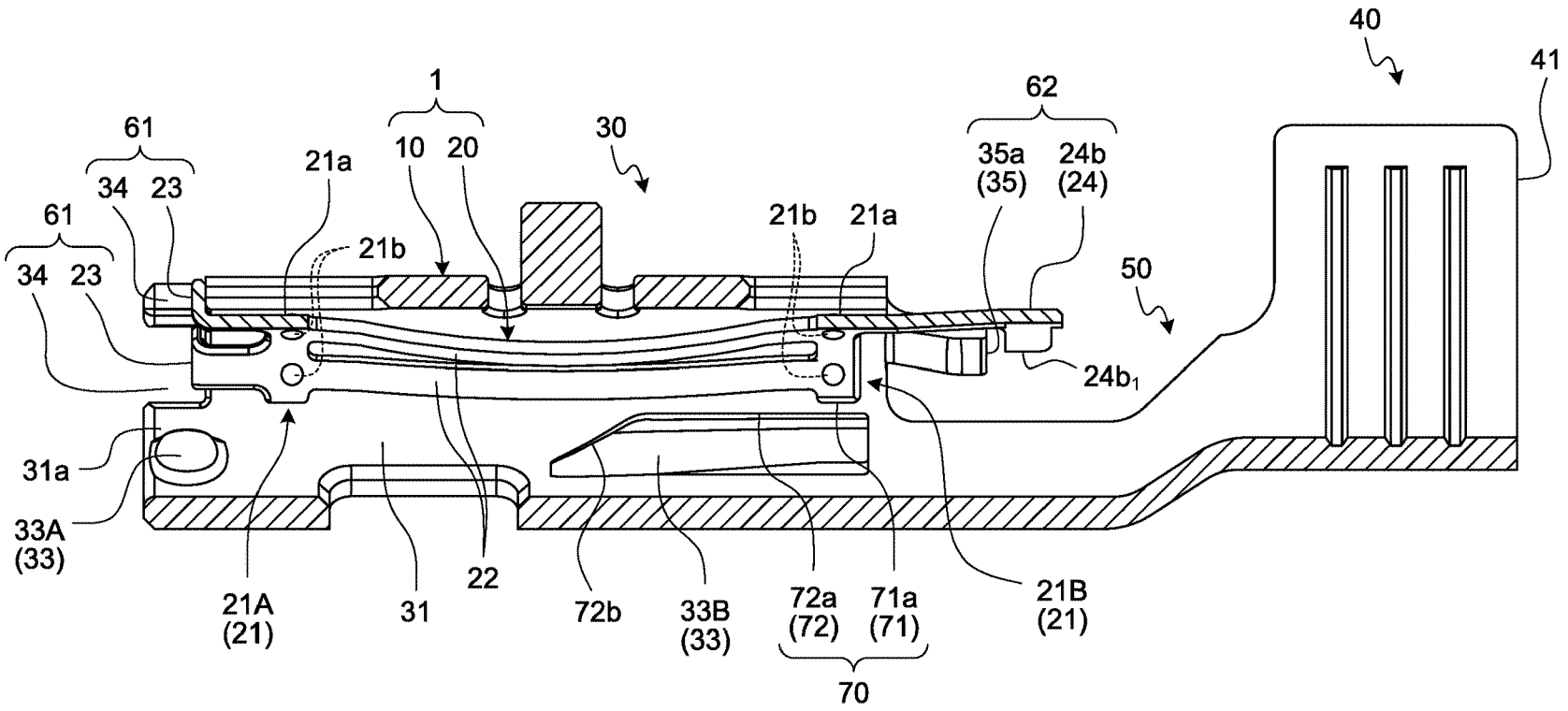
FIG. 4 is a cross-sectional view taken along line X-X in FIG. 1.

The connection terminal 1 includes a first locking structure 61. The first locking structure 61 reduces relative positional deviation in the insertion direction of the contact member 20 with respect to the female connector 30. The connection terminal 1 further includes a second locking structure 62. The second locking structure 62 reduces relative positional deviation in the removal direction of the contact member 20 with respect to the female connector 30 (FIGS. 1, 2, and 4).

The following describes the first locking structure 61. The first locking structure 61 holds the contact member 20 at a predetermined position in the axial direction (male terminal insertion and removal directions) inside the internal space 31 when the contact member 20 is to be housed in the internal space 31 and when the male connector Tm1 is to be housed in the internal space 31. The predetermined position refers to a position at which housing of the contact member 20 in the internal space 31 is completed. The first locking structure 61 includes a first locked body 23 and a first locking body 34 (FIGS. 1 to 4). The first locked body 23 is disposed in the contact member 20. The first locking body 34 is disposed in the female connector 30 and functions to lock movement of the first locked body 23 toward the male terminal insertion direction. The first locking structure 61 includes at least one each of the first locked body 23 and the first locking body 34. For example, the first locking structure 61 includes a plurality of sets of the first locked body 23 and the first locking body 34. In the present embodiment, the first locking structure 61 includes three sets disposed to be spaced apart from each other in the circumferential direction.

The first locked body 23 is formed so as, under a condition in which housing of the contact member 20 is completed, to protrude from the contact member 20 toward the inner circumferential surface 32 of the female connector 30. Additionally, under the condition in which housing of the contact member 20 is completed, the exemplary first locked body 23 is disposed on the side of the first opening 31*a* in the internal space 31. In the present embodiment, the first locked body 23 protrudes from an end of the first female-side contact part 21A on the side of the first opening 31*a* toward the side of the inner circumferential surface 32. Specifically, the exemplary first locked body 23 is formed into a tab and to protrude outwardly in the radial direction from the end of the first female-side contact part 21A on the side of the first opening 31*a*.

The first locking body 34 is configured so as to lock movement of the first locked body 23 toward the male terminal insertion direction in order to maintain the condition of the contact member 20 being housed in the internal space 31. The first locking body 34 is a cutout formed in the end of the female connector 30 on the side of the first opening 31*a*. Upon completion of housing of the contact member 20 in the internal space 31, the first locked body 23 is fitted into the first locking body 34. The first locking body 34 has a wall surface in the female connector 30 on the side of the male terminal insertion direction. The wall surface functions to lock movement of the first locked body 23 toward the male terminal insertion direction. The first locking body 34 has two other wall surfaces in the female connector 30 in the circumferential direction, so that the wall surfaces in the circumferential direction lock the movement of the first locked body 23 in the circumferential direction.

Under the condition in which housing of the contact member 20 in the internal space 31 is completed, the first locked body 23 may be in contact with, or spaced apart from, the first locking body 34. The spacing between the first locked body 23 and the first locking body 34 represents a relative movement amount over which the first locked body 23 at the position at which housing of the contact member 20 in the internal space 31 is completed moves to be locked in the first locking body 34. The spacing between the first locked body 23 and the first locking body 34 is set so that the relative movement amount falls within a permissible value. The permissible value is required only to fall within a range of the relative movement amounts of the first locked body 23, resulting in the electric connection state among the contact member 20, the female connector 30, and the male connector Tm1 not being impaired. The permissible value is exemplarily set to a maximum value of the relative movement amounts.

As described above, the first locking structure 61 can reduce not only the relative positional deviation of the contact member 20 with respect to the female connector 30 in the insertion direction, but also the relative positional deviation of the contact member 20 with respect to the female connector 30 in the circumferential direction.

The following describes the second locking structure 62. The second locking structure 62 holds the contact member 20 at a predetermined position in the axial direction (male terminal insertion and removal directions) inside the internal space 31 when the male connector Tm1 in the internal space 31 is to be removed via the first opening 31*a*. The predetermined position refers to the position at which housing of the contact member 20 in the internal space 31 is completed. The second locking structure 62 includes a second locked body 24 and a second locking body 35 (FIGS. 1 to 4). The second locked body 24 is disposed in the contact member 20. The second locking body 35 is disposed in the female connector 30 and functions to lock movement of the second locked body 24 toward the male terminal removal direction. The second locking structure 62 includes at least one each of the second locked body 24 and the second locking body 35. In the present embodiment, the second locking structure 62 includes one set of the second locked body 24 and the second locking body 35.

In the second locking structure 62, the second locked body 24 and the second locking body 35 are formed such that, upon completion of housing of the contact member 20 in the internal space 31, a locked part (a tab 24$b_1$ described later) of the second locked body 24 is disposed to face a locking part 35*a* of the second locking body 35 in the male terminal insertion and removal directions (FIGS. 1 to 4). It is noted that, in the second locking structure 62, the second locked body 24 and the second locking body 35 may be formed such that, during the process of the contact member 20 being inserted into the internal space 31, the second locked body 24 flexes to slide along the inner circumferential surface 32 of the female connector 30.

Figure 3:
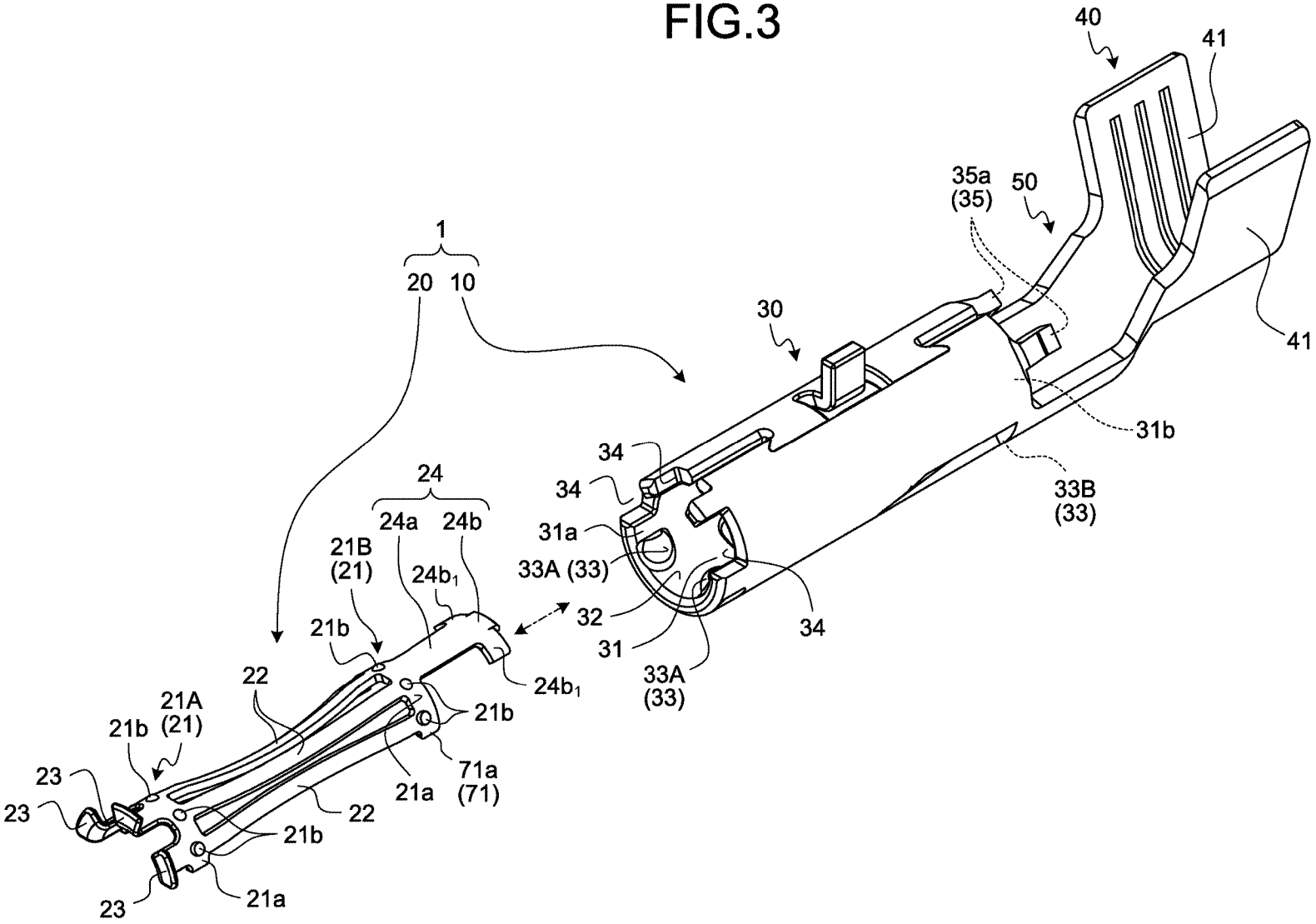
FIG. 3 is an exploded perspective view of the connection terminal in the embodiment.

The second locked body 24 protrudes from an end of the contact member 20 disposed on the side of the second opening 31*b* (the second female-side contact part 21B) toward the male terminal insertion direction (direction in which the contact member 20 is inserted into the internal space 31). The second locked body 24 is formed into a T-shape that includes a shaft 24*a* and an arcuate portion 24*b* (FIGS. 1 and 3). The shaft 24*a* protrudes from the second female-side contact part 21B. The arcuate portion 24*b* is disposed on an end of the shaft 24*a* on the side in a direction in which the shaft 24*a* protrudes. The shaft 24*a* is inclined outwardly in the radial direction with respect to the second female-side contact part 21B so that the arcuate portion 24*b* is disposed outside in the radial direction with respect to the second female-side contact part 21B. The shaft 24*a* may be configured to be elastic in the radial direction of the female connector 30. Additionally, the arcuate portion 24*b* has two tabs $24b_1$ as the locked parts. The tabs $24b_1$ each protrude from the shaft 24*a* in the circumferential direction.

The second locking body 35 protrudes from the end of the female connector 30 on the side of the second opening 31*b* toward the male terminal insertion direction. The second locking body 35 protrudes toward the tab $24b_1$ of the second locked body 24 of the contact member 20 that has been housed in place and faces the tab $24b_1$ in the male terminal insertion and removal directions. The second locking body 35 has an end on the side in the protruding direction facing the tab $24b_1$ in the male terminal insertion and removal directions. The second locking body 35 uses this end as the locking part 35*a*. The second locking body 35 is associated with each of the tabs $24b_1$. Specifically, two second locking bodies 35, which are spaced apart from each other in the circumferential direction, protrude from the end of the female connector 30 on the side of the second opening 31*b*.

Under the condition in which housing of the contact member 20 in the internal space 31 is completed, the tabs $24b_1$ of the second locked body 24 may be in contact with, or spaced apart from, the respective second locking bodies 35. The spacing between the tabs $24b_1$ of the second locked body 24 and the respective second locking bodies 35 represents a relative movement amount over which each of the tabs $24b_1$ at the position at which housing of the contact member 20 in the internal space 31 is completed moves to be locked in the corresponding one of the second locking bodies 35. The spacing between the tabs $24b_1$ of the second locked body 24 and the respective second locking bodies 35 is set so that the relative movement amount falls within a permissible value. The permissible value is required only to fall within a range of the relative movement amounts of the tabs $24b_1$ of the second locked body 24, resulting in the electric connection state among the contact member 20, the female connector 30, and the male connector Tm1 not being impaired. The permissible value is exemplarily set to a maximum value of the relative movement amounts.

In the second locking structure 62, under the condition in which housing of the contact member 20 in the internal space 31 is completed, the shaft 24*a* of the second locked body 24 is disposed between the two second locking bodies 35 and is disposed to face the second locking bodies 35 in the circumferential direction the female connector 30. In the second locking structure 62, under the condition in which the two second locking bodies 35 and the shaft 24*a* are disposed to face each other in the circumferential direction, the tabs $24b_1$ as the locked parts of the second locked body 24 and the locking parts 35*a* of the second locking bodies 35 are disposed to face each other in the male terminal insertion and removal directions. The foregoing arrangements enable the second locking structure 62 to reduce relative positional deviation of the contact member 20 with respect to the female connector 30 in the removal direction.

As described previously, the contact member 20 is disposed to face the inner circumferential surface 32 in the first region of the divided regions of the internal space 31. Thus, the contact member 20 can be inclined when the contact member 20 is to be inserted into the internal space 31 and when the contact member 20 has been housed in the internal space 31. In the second locking structure 62, depending on how the contact member 20 is inclined in the internal space 31, the tabs $24b_1$ of the second locked body 24 may not be disposed to face the locking parts 35*a* of the second locking bodies 35 in the male terminal insertion and removal directions. In an inclined condition in which the second female-side contact part 21B is apart from the inner circumferential surface 32 of the female connector 30, for example, the tabs $24b_1$ may not be disposed to face the locking parts 35*a* in the male terminal insertion and removal directions depending on the magnitude of the inclination.

The connection terminal 1 in the present embodiment thus includes a position adjustment structure 70 (FIGS. 2 and 4). The position adjustment structure 70 adjusts a position of the contact member 20 in the internal space 31 and, under the condition in which housing of the contact member 20 in the internal space 31 is completed, causes the second locking structure 62 to function.

The position adjustment structure 70 includes a locked holder 71 and a locking holder 72. The locked holder 71 is disposed in the contact member 20. The locking holder 72 is disposed in the terminal main body 10. The locked holder 71 and the locking holder 72 are not necessarily required to contact each other. The locked holder 71 and the locking holder 72 are required only to be able to contact each other when the second female-side contact part 21B is apart from the inner circumferential surface 32 of the female connector 30. The locking holder 72 includes a locking holding part 72*a*. The locking holding part 72*a* is capable of locking a locked holding part 71*a* of the locked holder 71 when the second female-side contact part 21B is apart from the inner circumferential surface 32 of the female connector 30 and, under the foregoing locking condition, the locking holding part 72*a* can hold the locked holding part 71*a*. The locking holding part 72*a* is formed so as to be capable of locking the locked holding part 71*a* within such a range that the tabs $24b_1$ as the locked parts and the locking parts 35*a* are disposed to face each other in the male terminal insertion and removal directions after the completion of housing of the contact member 20 in the internal space 31. The locking holding part 72*a* is formed so as further to be capable of holding the locked holding part 71*a* under the foregoing locking condition.

In the connection terminal 1, the tabs $24b_1$ as the locked parts of the second locked body 24 and the locking parts 35*a* of the second locking bodies 35 can be disposed to face each other in the male terminal insertion and removal directions as long as the second female-side contact part 21B contacts the inner circumferential surface 32 of the female connector 30 when the condition in which housing of the contact member 20 in the internal space 31 is completed is established. Additionally, in the connection terminal 1, even when the second female-side contact part 21B is apart from the inner circumferential surface 32 of the female connector 30 when the condition in which housing of the contact member 20 in the internal space 31 is completed is established, the position adjustment structure 70 enables the tabs $24b_1$ as the locked parts and the locking parts 35*a* to be disposed to face each other in the male terminal insertion and removal directions.

The position adjustment structure 70 may be configured such that, while the contact member 20 is being inserted into the internal space 31, the locking holding part 72*a* applies pressure to the locked holding part 71*a* to thereby cause the second female-side contact part 21B to be pressed against the inner circumferential surface 32 of the female connector 30.

Specifically, the position adjustment structure 70 in the present embodiment uses the second female-side contact part 21B as the locked holder 71 and uses both circumferential ends of the second female-side contact part 21B as the locked holding parts 71*a*. In addition, the position adjustment structure 70 in the present embodiment uses, as the locking holder 72, a bulge that bulges from the inner circumferential surface 32 of the female connector 30 for each of the locked holding parts 71*a*. The locking holder 72 has a flat surface portion that is provided in a connected row arrangement with the second terminal main body contact parts 33B and extends in the cylindrical axis direction of the female connector 30. The locking holder 72 uses the flat surface portion as the locking holding part 72*a*.

The locking holding part 72*a* may be formed so as to be capable of locking and holding the locked holding part 71*a* before the completion of housing of the contact member 20 in the internal space 31. The locking holder 72 may further have an inclined surface portion 72*b* (FIG. 4). The inclined surface portion 72*b* may be formed so as to be continuous with the locking holding part 72*a* on the side of the first opening 31*a*. For example, in the locking holder 72, the abovementioned flat surface portion is extended toward the side of the first opening 31*a* to thereby extend the locking holding part 72*a* to the side of the first opening 31*a* and the inclined surface portion 72*b* is connected with the locking holding part 72*a* on the side adjacent to the first opening 31*a*. The inclined surface portion 72*b* is spaced farther apart from the first region of the divided regions of the internal space 31 at shorter distances from the first opening 31*a*. When the contact member 20 is inserted into the internal space 31, the inclined surface portion 72*b* can serve as a guide for guiding the locked holding part 71*a* up to the locking holding part 72*a*. The foregoing feature improves operability involved in inserting the contact member 20 into the internal space 31.

As described above, the connection terminal 1 in the present embodiment can restrict changes in the position of the contact member 20 in the internal space 31 using the position adjustment structure 70. Thus, the connection terminal 1 can cause the tabs $24b_1$ as the locked parts of the second locked body 24 and the locking parts 35*a* of the second locking bodies 35 to be disposed to face each other in the male terminal insertion and removal directions regardless of the position of the contact member 20. The connection terminal 1 in the present embodiment can thus maintain the position of the contact member 20 with respect to the terminal main body 10.

Modification

Figure 5:
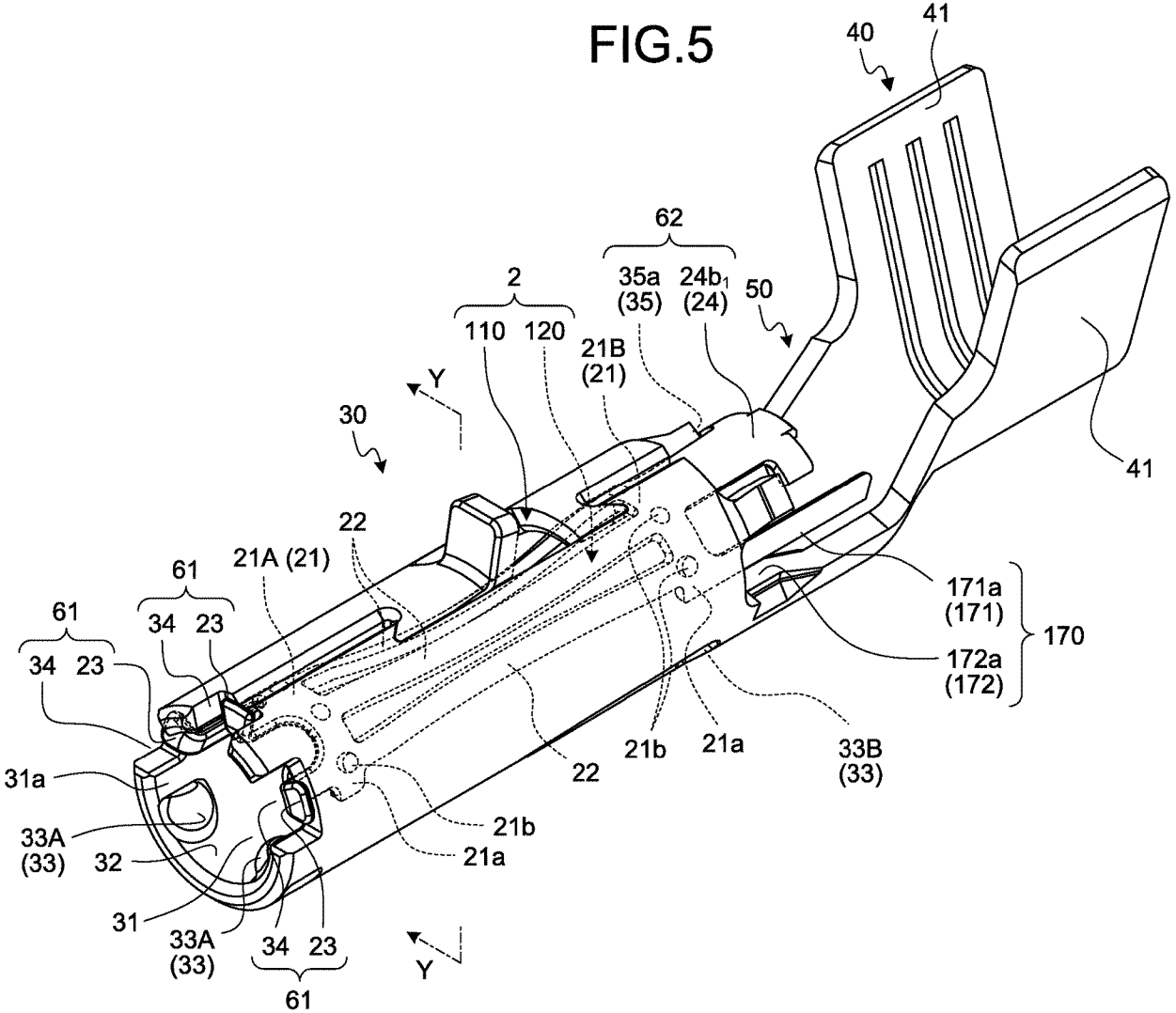
FIG. 5 is a perspective view of a connection terminal in a modification.
Figure 6:
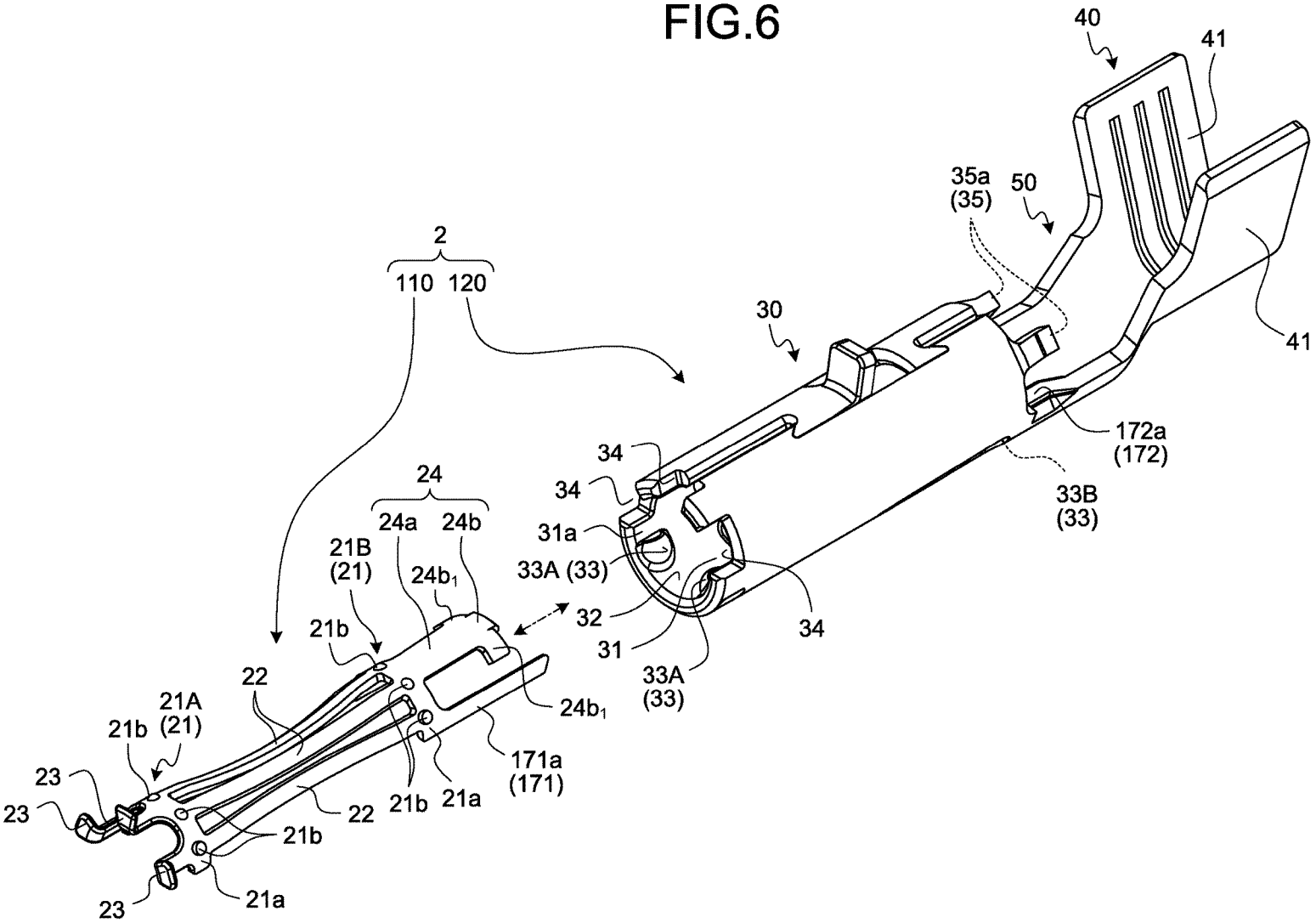
FIG. 6 is an exploded perspective view of the connection terminal in the modification.
Figure 7:
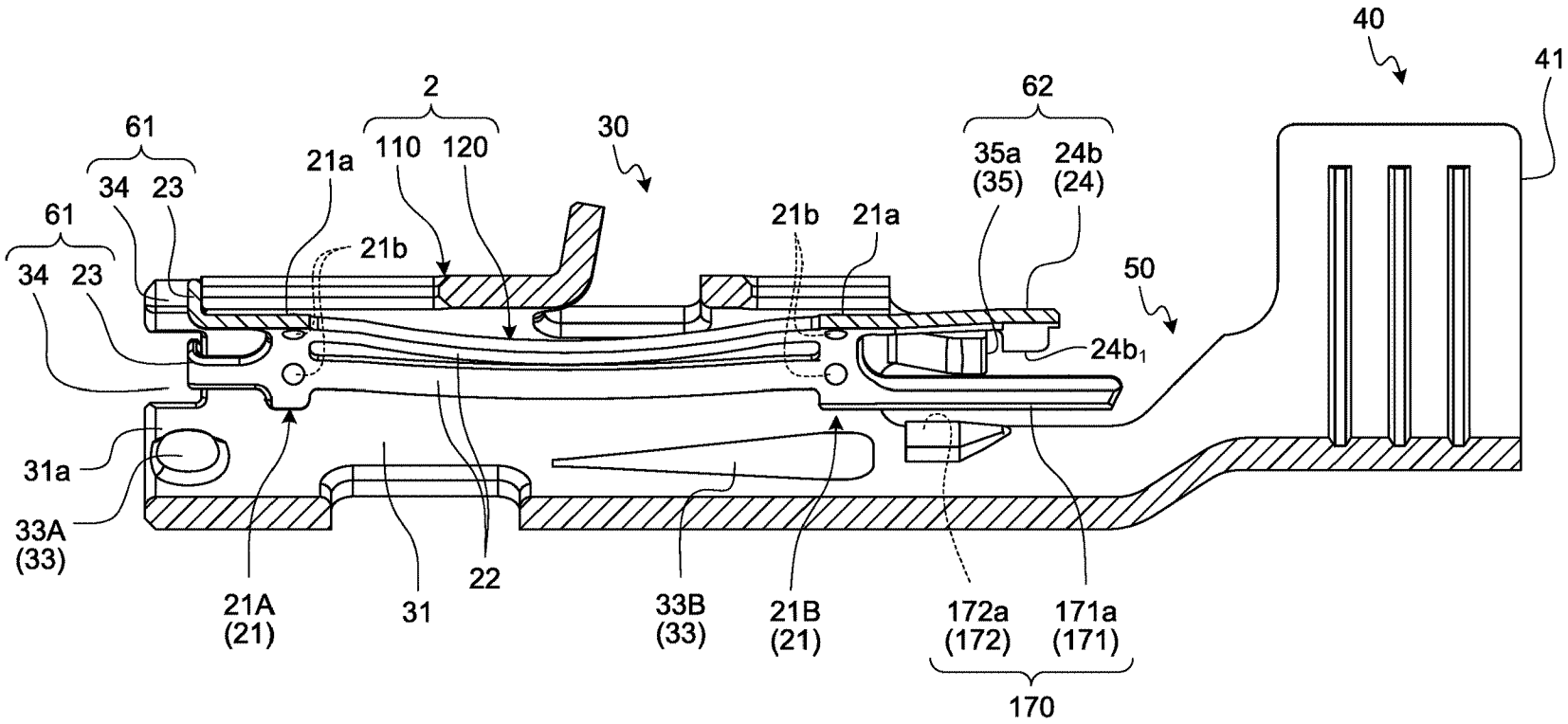
FIG. 7 is a cross-sectional view taken along line Y-Y in FIG. 5.

The following describes, with reference to FIGS. 5 to 7, a connection terminal 2 according to a modification. The connection terminal 2 in the modification represents the connection terminal 1 in the present embodiment described above, in which the position adjustment structure 70 is replaced by a position adjustment structure 170 described below. Thus, in the modification, like reference numerals denote like parts described with reference to the connection terminal 1 in the present embodiment and descriptions for those parts will be omitted.

The connection terminal 2 in the modification includes a terminal main body 110 and a contact member 120. The terminal main body 110 has configurations similar to the configurations of the terminal main body 10 in the present embodiment, except for portions relating to the position adjustment structure 170 described later. The contact member 120 has configurations similar to the configurations of the contact member 20 in the present embodiment, except for portions relating to the position adjustment structure 170 described later.

The position adjustment structure 170 in the modification includes a locked holder 171 and a locking holder 172. The locked holder 171 is disposed in the contact member 120. The locking holder 172 is disposed in the terminal main body 110. The locked holder 171 and the locking holder 172, which have different shapes and are disposed at different positions from the locked holder 71 and the locking holder 72 in the present embodiment, achieve functions identical to the functions achieved by the locked holder 71 and the locking holder 72 in the present embodiment. Thus, in the position adjustment structure 170, the locked holder 171 includes a locked holding part 171*a* and the locking holder 172 includes a locking holding part 172*a*. The locking holding part 172*a* is formed so as to be capable of locking the locked holding part 171*a* within such a range that the tabs $24b_1$ as the locked parts and the locking parts 35*a* are disposed to face each other in the male terminal insertion and removal directions after the completion of housing of the contact member 120 in the internal space 31. The locking holding part 172*a* is formed so as further to be capable of holding the locked holding part 171*a* under the foregoing locking condition.

Specifically, the position adjustment structure 170 in the modification includes two locked holders 171. The locked holders 171 protrude from circumferential ends of the second female-side contact part 21B toward the male terminal insertion direction. The exemplary locked holders 171 protrude from the second opening 31*b* as with the second locked body 24 under the condition in which housing of the contact member 120 in the internal space 31 is completed. The locking holder 172 is provided for each of the locked holders 171. In the modification, protrusions protruding from the connecting bridge 50 toward the locked holders 171 under the condition in which housing of the contact member 120 in the internal space 31 is completed are used as the locking holders 172. The locking holders 172 each have a flat surface portion that extends in the cylindrical axis direction of the female connector 30. The locking holders 172 each use the flat surface portion as the locking holding part 172*a*.

As with the present embodiment, the locking holding part 172*a* may be formed so as to be capable of locking and holding the locked holding part 171*a* before the completion of housing of the contact member 120 in the internal space 31. The locked holders 171 in the modification are extended in the male terminal insertion direction, so that the locking and holding of the locked holding part 171*a* are enabled even before the completion of housing of the contact member 120 in the internal space 31. Additionally, in the modification, when the contact member 120 is inserted into the internal space 31, the second terminal main body contact parts 33B serve as a guide for guiding the locked holding part 171*a* up to the locking holding part 172*a*. Thus, assuming the first opening 31*a* side as a starting point, the second terminal main body contact parts 33B in the modification bulge gradually a greater amount toward the second opening 31*b* side. Thus, in the modification, too, the connection terminal 2 can improve operability involved in inserting the contact member 120 into the internal space 31.

As described above, the connection terminal 2 in the modification can restrict changes in the position of the contact member 120 in the internal space 31 using the position adjustment structure 170. Thus, the connection terminal 2 can cause the tabs 24$b_1$ as the locked parts of the second locked body 24 and the locking parts 35*a* of the second locking bodies 35 to be disposed to face each other in the male terminal insertion and removal directions regardless of the position of the contact member 120. The connection terminal 2 in the modification can thus maintain the position of the contact member 120 with respect to the terminal main body 110.

The connection terminal according to the aspect of the present embodiments can restrict changes in the position of the contact member in the internal space using the position adjustment structure. Thus, the connection terminal can cause the locked part of the locked body and the locking part of the locking body to be disposed to face each other in the male connector insertion and removal directions regardless of the position of the contact member. The connection terminal in the aspect of the present embodiments can thus maintain the position of the contact member with respect to the terminal main body.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal, comprising:

an electrically conductive terminal main body including: a female connector that has a columnar internal space in which a male connector of a mating male terminal is to be inserted; and an electric wire connector with which an electrically conductive part of an electric wire is to be electrically connected;

a contact member that is disposed to face an inner circumferential surface of the female connector in a first region of two divided regions of the internal space, the two divided regions extending along insertion and removal directions of the male connector, that is electrically connected with the female connector by the inner circumferential surface of the female connector, and that is to be electrically connected with the male connector inserted in the internal space through a first opening in the female connector;

a locking structure that holds the contact member at a position at which the contact member is disposed after completion of housing of the contact member in the internal space; and a position adjustment structure that adjusts a position of the contact member in the internal space, wherein the locking structure includes: a locked body that protrudes from an end of the contact member disposed on a side of a second opening in the female connector toward a direction in which the contact member is inserted into the internal space; and a locking body that protrudes from an end on the side of the second opening in the female connector toward the direction in which the contact member is inserted into the internal space, the locked body includes a locked part and the locking body includes a locking part such that, upon completion of housing of the contact member in the internal space, the locked part of the locked body is disposed to face the locking part of the locking body in the insertion and removal directions of the male connector, the position adjustment structure includes a locked holder disposed in the contact member and a locking holder disposed in the terminal main body, and the locking holder includes a locking holding part capable of locking a locked holding part of the locked holder within such a range that the locked part and the locking part are disposed to face each other in the insertion and removal directions of the male connector after the completion of housing of the contact member in the internal space, the locking holding part further being capable of holding the locked holding part under the foregoing locking condition.

2. The connection terminal according to claim 1, wherein the locking holding part is formed so as to be capable of locking and holding the locked holding part before the completion of housing of the contact member in the internal space.

3. The connection terminal according to claim 1, wherein the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; and the locked body that protrudes from the second female-side contact part disposed on the side of the second opening toward the insertion direction, and the position adjustment structure uses, as the locked holder, the second female-side contact part that extends along a circumferential direction of the inner circumferential surface of the female connector, uses, as the locked holding part, circumferential ends of the second female-side contact part, and uses, as the locking holder, a bulge that bulges from the inner circumferential surface of the female connector for each locked holding part.

4. The connection terminal according to claim 2, wherein the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; and the locked body that protrudes from the second female-side contact part disposed on the side of the second opening toward the insertion direction, and the position adjustment structure uses, as the locked holder, the second female-side contact part that extends along a circumferential direction of the inner circumferential surface of the female connector, uses, as the locked holding part, circumferential ends of the second female-side contact part, and uses, as the locking holder, a bulge that bulges from the inner circumferential surface of the female connector for each locked holding part.

5. The connection terminal according to claim 1, wherein the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; the locked body that protrudes from the second female-side contact part disposed on the side of the second opening toward the insertion direction; and the locked holder that protrudes toward the insertion direction from circumferential ends of the second female-side contact part that extends circumferentially along the inner circumferential surface of the female connector, and the locking holder is provided for each locked holder.

6. The connection terminal according to claim 1, wherein the contact member includes: first and second female-side contact parts, spaced apart from each other in the insertion and removal directions, for establishing an electric connection with the inner circumferential surface of the female connector; a male-side contact part that connects between the first and the second female-side contact parts and that is electrically connected with the male connector inserted in the internal space; the locked body that protrudes from the second female-side contact part disposed on the side of the second opening toward the insertion direction; and the locked holder that protrudes toward the insertion direction from circumferential ends of the second female-side contact part that extends circumferentially along the inner circumferential surface of the female connector, and the locking holder is provided for each locked holder.

* * * * *